US005621971A

United States Patent [19]

Szymansky

[11] Patent Number: 5,621,971

[45] Date of Patent: Apr. 22, 1997

[54] MULTI-PURPOSE ATTACHMENT FOR LADIES' SHAVER

[75] Inventor: Edward Szymansky, Fairfield, Conn.

[73] Assignee: Remington Products Company, Bridgeport, Conn.

[21] Appl. No.: 501,694

[22] Filed: Jul. 12, 1995

[51] Int. Cl.[6] ..... B26B 19/42

[52] U.S. Cl. ..... 30/43.6; 30/34.2

[58] Field of Search ..... 30/43.4, 43.5, 30/43.6, 286, 287, 34.2

[56] References Cited

U.S. PATENT DOCUMENTS

| | | | |
|---|---|---|---|
| 3,070,884 | 1/1963 | Vaes | 30/43.6 |
| 3,992,775 | 11/1976 | De Vries | 30/34.2 |
| 4,250,617 | 2/1981 | Bakker et al. | 30/43.6 X |
| 4,698,908 | 10/1987 | Bergsma et al. | 30/43.6 |

FOREIGN PATENT DOCUMENTS

| | | | |
|---|---|---|---|
| 54-123361 | 9/1979 | Japan | 30/43.6 |
| 7607258 | 1/1978 | Netherlands | 30/43.6 |

*Primary Examiner*—Hwei-Siu Payer
*Attorney, Agent, or Firm*—Melvin I. Stoltz

[57] ABSTRACT

A unique, highly effective, electric dry shaver incorporating rotary cutting blades for use by women to effectively, conveniently, and comfortably shave both legs and underarms is achieved by incorporating a blade guard removably mountable to the electric shaver for partially blocking the rotary cutting blades while also smoothing and/or stretching the soft underarm skin. By employing the rotary cutting blade guard of the present invention, the soft, pliable skin typically found in underarms is comfortably smoothed, spread, and/or stretched to prevent any cutting or pinching of the skin by the blades. As a result, a close, comfortable shave is attained, with all of the hair being completed cut, regardless of the contours of the skin surface or the soft, pliable nature of the skin. Furthermore, when the legs are to be shaven, the blade guard is removed thereby fully exposing the side walls of the slotted outer cutter so it can be used in its entirety.

18 Claims, 2 Drawing Sheets

MULTI-PURPOSE ATTACHMENT FOR LADIES' SHAVER

TECHNICAL FIELD

This invention relates to electric dry shavers and, more particularly, to a ladies' electric shaver incorporating rotary cutting blades and a removable attachment therefor for effectively, conveniently, and comfortably shaving both legs and underarms.

BACKGROUND ART

Over the last several years, both men and women have been increasingly drawn to the advantages provided by electric dry shavers. In general, the consuming public has found that the use of razors or other systems is extremely inconvenient for removing or shaving short hair or stubble, as commonly found in mens' beards and womens' legs. In addition, with the ever increasing time constraints and commitments individuals typically encounter, a fast and effective shaving system is most desirable.

The discomfort as well as the time consumed in using shaving cream, soaps and gels in order to provide a medium for which a razor can be used, requires more time and inconvenience than most individuals are willing or capable of allowing. Furthermore, the cost of maintaining a sufficient supply of these products creates an additional burden. Consequently, electric dry shavers have become increasingly popular, as well as battery operated electric dry shavers which can withstand exposure to moisture, enabling individuals to simultaneously shower as well as shave either beards or legs.

As the popularity of electric shavers increased, various product designs and alternate constructions proliferated, in an attempt to improve and enhance the comfort and cutting efficiency of such shavers. However, in spite of these product changes, difficulties have continued to exist in providing optimum results with optimum comfort.

One particular configuration that has been found to be effective in achieving high quality shaving results for both men and women, while also being comfortable to use employs a movable cutting blade which cooperates with a thin, flexible, mesh screen aperture foil. Numerous configurations and various models of an electric shaver based upon this cutting method have been developed for use by both men and women.

In addition to the foil cutting system, the other principal cutting construction employed for electric shavers is the rotary blade construction. Unfortunately, although the foil cutting system has been effectively used for both men and women, the rotary cutting blade system has been employed in electric dry shavers principally for men only.

In general, rotary cutting blade shavers for women to use in shaving their legs and underarms have been incapable of achieving any commercial success. Typically, prior art attempts to create a ladies' shaver using rotary cutting blades has failed due to the inability of the different hair types and hair lengths to be accommodated by the rotary shaver, without causing extreme discomfort. As a result, prior attempts to achieve such a product has met with failure.

Although it has been found that rotary cutting blades do have some inherent advantages in handling hairs having lengths greater than the short hair length most easily accommodated by foil-type shavers, rotary cutting blade systems have been incapable of being effectively employed by women for comfortably shaving their legs and their underarms. In addition to the wide variety of hair lengths encountered in these arms, the skin composition in these two areas differs substantially, causing rotary cutting blades to pinch and cut the skin surface typically found in a lady's underarm.

Consequently, it is a principal object of the present invention to provide a ladies' electric shaver incorporating rotary cutting blades that can be employed effectively and comfortably on both legs and underarms.

Another object of the present invention is to provide a ladies' rotary blade electric shaver having the characteristic features described above which is capable of being easily and conveniently used on both legs and underarms without causing irritation or pain.

Another object of the present invention is to provide a ladies' rotary blade electric shaver having the characteristic features described above which produces a smooth, close shave and incorporates a removable blade guard for enhancing the performance of the rotary blades, particularly when employed for cutting underarms.

Another object of the present invention is to provide a ladies' rotary blade electric shaver having the characteristic features described above wherein the removable blade guard is easily mounted to the shaver for use as well as easily removed therefrom when use of the shaver on legs is desired.

Other and more specific objects will in part be obvious and will in part appear hereinafter.

SUMMARY OF THE INVENTION

By employing the present invention, the prior art difficulties and drawbacks are overcome and a unique, highly effective, electric dry shaver incorporating rotary cutting blades is achieved that can be used by women for effectively, conveniently, and comfortably shaving both legs and underarms. In accordance with the present invention, these attributes are attained by employing a blade guard removably mounted to the electric shaver for use when using the shaver on underarms or other tender areas.

By employing the rotary cutting blade guard of the present invention, the soft, pliable skin typically found in underarms is deflected and comfortably spread or stretched in order to prevent any cutting or pinching of the skin by the rotating blades. Furthermore, by employing the rotary blade guard of this invention, a close, comfortable shave is attained, with all of the hair fibers being completed cut, regardless of the contours of the skin surface or the soft, pliable nature of the skin.

In the preferred embodiment, the rotary blade guard of the present invention is constructed for peripherally surrounding the outer edge of the slotted housing within which the cutting blades are mounted. As a result, when in position, the blade guard provides a plate member having a surface which is cooperatively associated with the outer peripheral edge of the slotted housing for partially blocking the slotted housing of each cutting blade member. Although a triple headed shaver can be employed for this purpose, it is preferred that the shaver be formed employing two cooperating rotary cutting heads. In this way, the overall shaver is slimmer in construction and more effectively employed on both legs and underarms.

Although the blade guard of the present invention can be formed in a variety of alternate constructions for removable cooperating association with the electric dry shaver, the preferred construction for the cutting blade guard of the present invention comprises a removable attachment which peripherally surrounds and lockingly engages the upper housing of the shaver in cooperating alignment with the rotary cutting blade assemblies. In this way, the blade guard of the present invention comprises a structure which is easily handled by the user for being readily mounted to the shaver for use as well, as easily removed from the shaver when use is not required.

In the preferred embodiment of the present invention, the blade guard is constructed with a substantially flat plate incorporating two circular-shaped apertures cooperatively associated with the plate to peripherally surround and partially block each of the slotted housings of the electric dry shaver. In addition, in the preferred construction, an upstanding rib or ridge is formed substantially perpendicular with the surface of the plate for peripherally surrounding substantially the entire outer peripheral surface of the cutting slotted housing, with the upstanding ridge or rib being in juxtaposed, spaced, cooperating relationship therewith.

By employing this construction, it has been found that optimum results are achieved with underarm skin being gently manipulated or stretched prior to being contacted by the cutting blade, thereby preventing unwanted skin pinching or cutting. As a result, shaving comfort of the underarm area is obtained and a rotary shaver is capable of being used by women to shave areas that have heretofore been incapable of being shaved with prior art rotary blade systems.

The invention accordingly comprises the features of construction, combinations of elements and arrangement of parts which will be exemplified in the construction hereinafter set forth, and the scope of the invention will be indicated in the claims.

THE DRAWINGS

For a fuller understanding of the nature and objects of the invention, reference should be had to the following detailed description taken in connection with the accompanying drawings in which.

DETAILED DESCRIPTION

Figure 3:
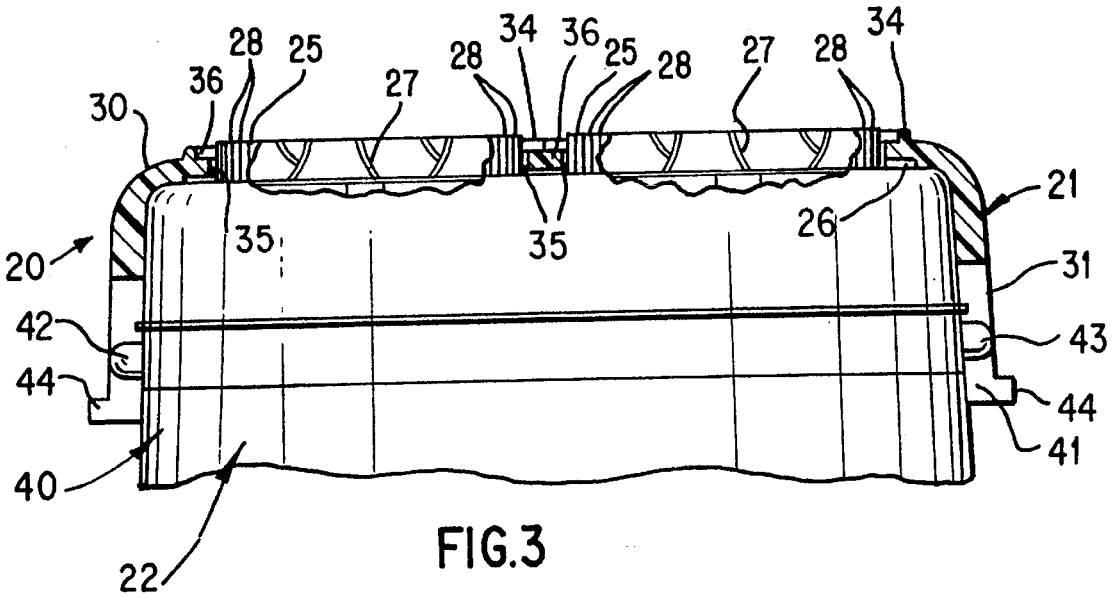
FIG. 3 is a side elevation view, partially in cross section, depicting the rotary blade shaver with the rotary blade guard of the present invention thereof mounted in association therewith.
Figure 4:
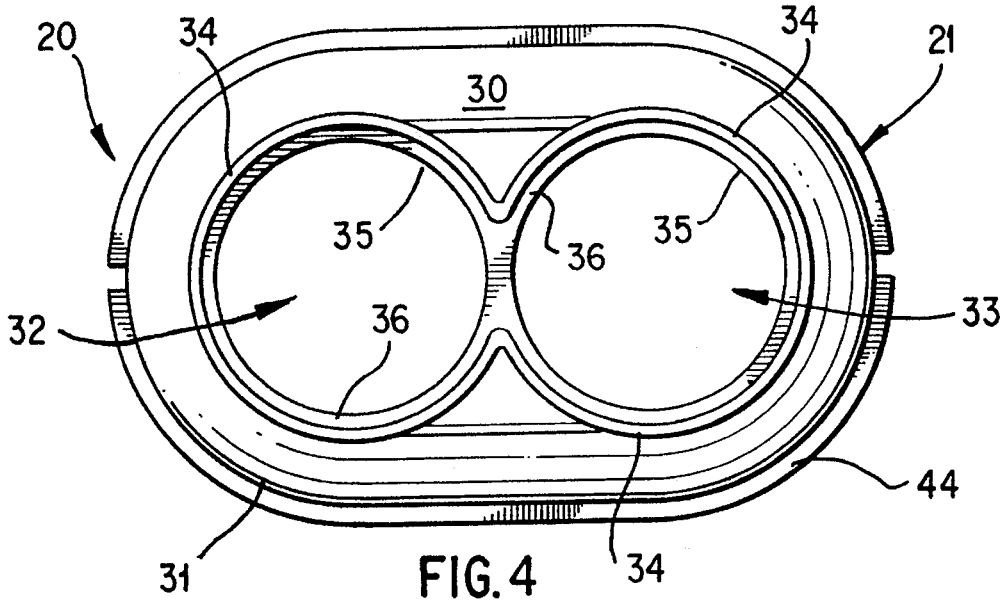
FIG. 4 is a top plan view of the rotary blade guard of the present invention shown independently.
Figure 5:
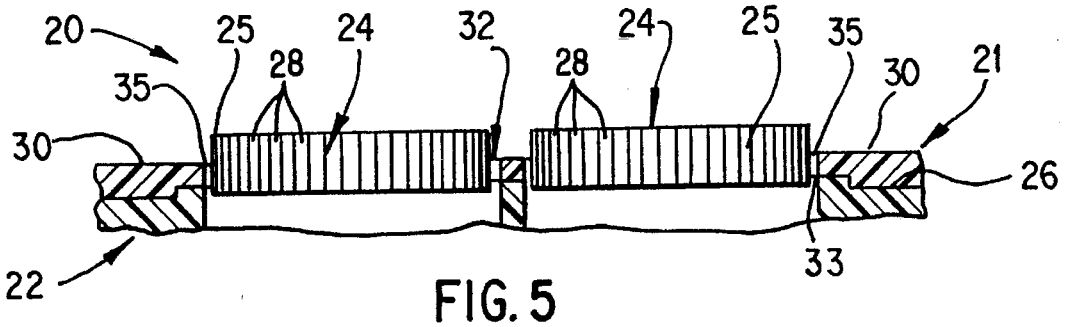
FIG. 5 is a cross-sectional, side elevation view, partially broken away, of an alternate embodiment of the rotary blade shaver with the rotary blade guard of the present invention mourned in association therewith.

By referring to FIGS. 1–5, the construction and operation of the blade guard of the present invention and its use with a multi-purpose ladies' rotary shaver can best be understood. In FIGS. 1–4, the preferred embodiment of the present invention is depicted, with FIG. 5 showing an alternate embodiment. However, as will be evident from the following detailed disclosure, further alternate embodiments employing the present invention can be made, without departing from the scope of this invention.

In FIGS. 1–4, multi-purpose ladies' rotary shaver assembly 20 is shown comprising the preferred embodiment of removable skin smoothing or stretching blade guard 21 and twin blade rotary shaver 22. Although it is possible to employ the present invention using three rotary cutting blades arranged in a conventional manner, the preferred embodiment employs twin rotary shaver construction 22 for purposes of size and convenience.

Figure 1:
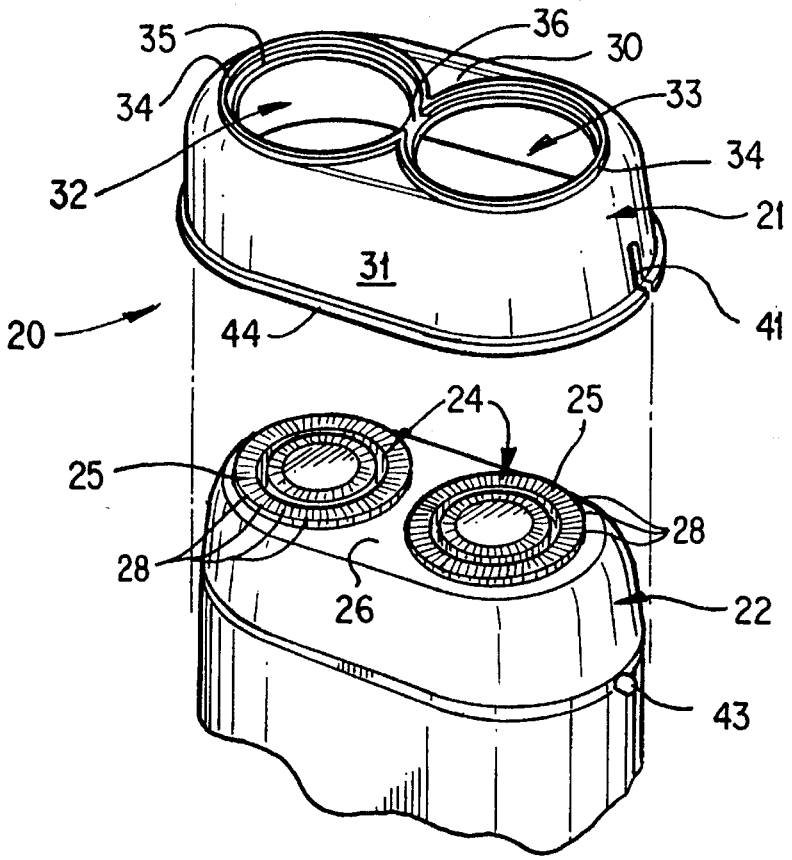
FIG. 1 is an exploded perspective view, partially broken away, depicting a dual headed rotary shaver with the rotary blade guard of the present invention positioned prior to mounted interengagement with the shaver.

Twin blade rotary shaver 22 comprises a generally conventional construction incorporating two conventionally constructed hair cutting assemblies 24. Each hair cutting assembly 24 comprises a circular shape, apertured or slotted housing 25, within which the cutting blade 27 (FIG. 3) is rotationally mounted for cutting cooperation therewith. As best seen in FIGS. 1, 3 and 5, each slotted housing 25 comprises a plurality of slots 28 formed therein, radially extending on the top surface of housing 25 and vertically extending along the outer peripheral wall of housing 25.

In its conventional use, top surface 26 of twin blade rotary shaver 22 is advanced on the skin surface of the legs or underarms to be shaved causing the hair fibers to be engaged and cut by hair cutting assemblies 24, 24. However, as detailed above, whenever such prior art use of a rotary blade shaver was made, substantial irritation was caused to the underarms of the user due to the entrapment of either longer hairs or the soft, pliable, tender skin in slotted housings 25, 25. As a result, the use of rotary blade shavers fell in disfavor, and until the present invention, have not been used as a shaving method for a ladies' electric dry shaver.

In the present invention, these prior art difficulties, drawbacks, and limitations are overcome by incorporating removable, skin-smoothing or stretching, blade guard 21. In the preferred embodiment, blade guard 21 comprises a substantially flat, upper plate or platform 30 which is peripherally surrounded by and integrally interconnected with a depending, substantially continuous side wall 31. In this preferred construction, side wall 31 and upper plate or platform 30 are formed as a single, integral component.

Skin smoothing/stretching blade guard 21 also incorporates substantially circular shaped apertures 32 and 33 formed in upper platform 30. Apertures 32 and 33 are both constructed with a diameter slightly greater than the diameter of circular shaped slotted housings 25, 25 in order to be mountable in peripherally surrounding, cooperating alignment with slotted housings 25, 25.

As best seen in FIGS. 1, 3, and 4, skin smoothing/stretching blade guard 21 is preferably constructed with apertures 32 and 33 independently defined by a substantially circular shaped edge 35, which is in peripheral surrounding, juxtaposed, spaced, cooperating relationship with the side wall of slotted housing 25. In addition, platform 30 preferably incorporates an upstanding ridge 34 extending substantially perpendicularly therefrom, positioned in peripheral surrounding relationship with apertures 32 and 33.

In the preferred construction, upstanding ridge 34 is formed as a substantially continuous upstanding member, encircling apertures 32 and 33 substantially in their entirety. Furthermore, in this preferred construction, upstanding, substantially perpendicular ridge 34 is spaced away from edge 35 of apertures 32 and 33, establishing a substantially flat, peripheral ring shaped surface 36 between edge 35 and ridge 34 about both apertures 32 and 33.

By employing this construction, optimum control of the skin surface in the underarm area is attained. When employed, blade guard 21 provides a smoothing of the soft, pliable underarm skin, as well as gently stretching the skin for optimum hair cutting. In this way, unwanted skin or irritation is prevented, and a smooth, close cutting of the hair fibers is achieved. As a result, by employing this construction, a close comfortable shave of underarm areas is attained.

Figure 2:
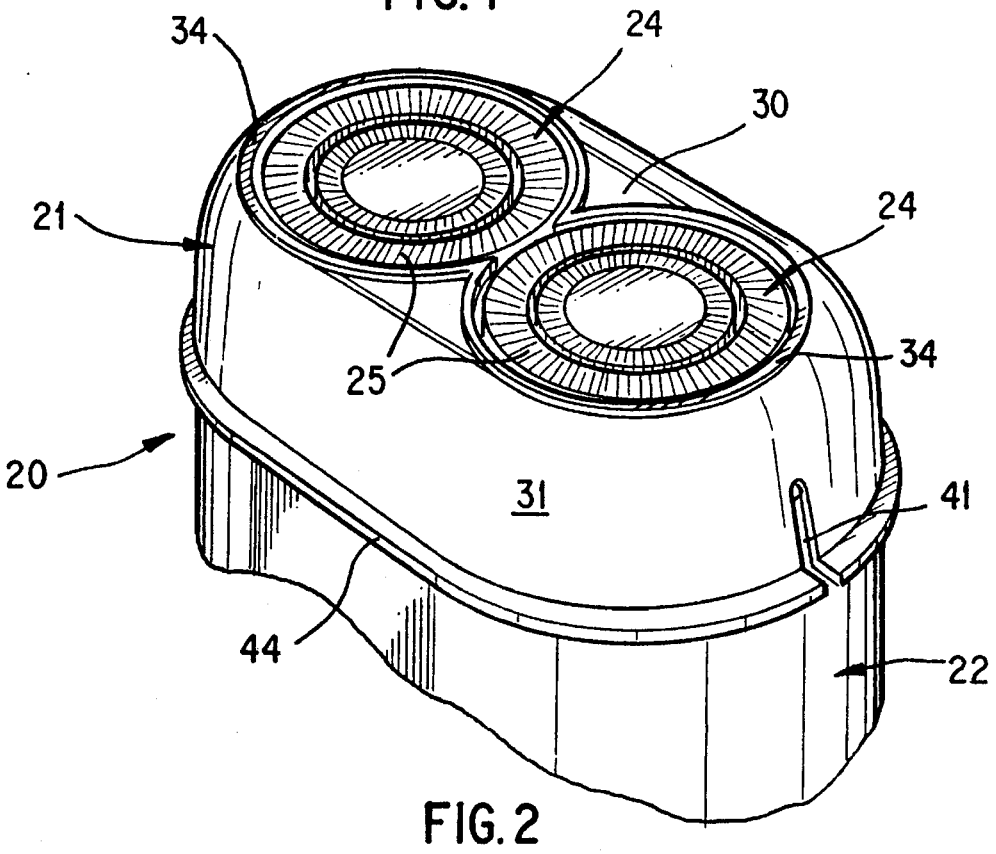
FIG. 2 is a perspective view of the shaver of the present invention with the rotary blade guard of the present invention securely mounted to the shaver in the desired position.

As best seen in FIGS. 2 and 3, when mounted in place, upper platform 30 of blade guard 21 peripherally surrounds slotted housings 25, 25 effectively blocking a substantial portion of the slots thereof. The top surface of platform 30 effectively elevates top surface 26 of rotary shaver 22 to a plane peripherally surrounding and effectively blocking about 50% of the vertical height of slotted housings 25, 25. As a result, whenever skin smoothing/stretching blade guard 21 is installed in position, hair cutting assemblies 24, 24 are substantially prevented from causing irritation or unwanted cutting or pinching of the skin surface.

Furthermore, by incorporating upstanding ridge 34 and positioning ridge 34 in peripheral surrounding relationship with apertures 32 and 33, upstanding ridge 34 cooperates with the top surface of platform 30 to peripherally surrounds slotted housings 25 and 25, when blade guard 21 is mounted in place. As a result, upstanding ridge 34 gently guides and controls the skin surface in the underarm areas, causing the skin to be stretched away from slotted housings 25. This construction prevents the soft, pliable skin from being trapped within slotted housing 25, thereby virtually eliminating cuts and irritation thereto. As a result, completely controlled, gentle, smooth and comfortable shaving of the underarm area is realized.

In order to enable multi-purpose, ladies' rotary shaver assembly 20 to function effectively for both underarms and legs, skin smoothing/stretching blade guard 21 is constructed for being quickly and easily securely mounted to rotary shaver 22, as well as rapidly removed therefrom. In FIGS. 1, 2, and 3, one embodiment for attaining this easy, securability, and rapid removability is fully depicted. However, as is readily apparent to one of ordinary skill in the art, skin smoothing/stretching blade guard 21 can be constructed in a variety of alternate ways to attain the desired securability and removability.

In the preferred construction, skin smoothing/stretching blade guard 21 incorporates slots 40 and 41 formed in side wall 31 of skin smoothing/stretching blade guard 21. Slots 40 and 41 are constructed for cooperative interlocking engagement with pins 42 and 43, which extend outwardly from the side of shaver 22.

By employing this construction, blade guard 21 is quickly and easily securely mounted to shaver 22, by merely placing side wall 31 in surrounding engagement with the upper portion of rotary shaver 22, with slot 40 of blade guard 21 aligned with pin 42 of shaver 22, while slot 41 of blade guard 21 is aligned with pin 43 of shaver 22. Then, blade guard 21 is advanced downwardly into secure interengagement with shaver 22. When blade guard 21 is in overlying, secure, locked interengagement with top surface 26 of shaver 22, pins 42 and 43 of shaver 22 are in locked interengagement with slots 40 and 41 of blade guard 21. When mounted in this position, blade guard 21 is securely affixed to rotary shaver 22, ready for use in smoothly and comfortably shaving any desired underarm area.

Whenever shaver 22 is to be employed for shaving legs, blade guard 21 is preferably removed, in order to allow hair cutting assemblies 24, 24 to be fully exposed for optimum use. In order to facilitate the removal of blade guard 21 from shaver 22, when full use of cutting assemblies 24, 24 is desired, blade guard 21 preferably incorporates flange 44, peripherally surrounding the base of side wall 31 and extending outwardly therefrom.

By gently pushing upwardly on flange 44, slots 40 and 41 are advanced out of locked interengagement with pins 42 and 43. This action releases blade guard 21 and allows blade guard 21 to be easily removed from shaver 22 and set aside for subsequent use.

As is evident from the foregoing detailed disclosure, by employing skin smoothing/stretching blade guard 21 of the present invention, rotary shaver 22 can be effectively employed for smoothly and comfortably cutting both underarms and legs of any individual. Whenever the legs of the user are to be shaved, blade guard 21 is removed, to allow hair cutting assemblies 24, 24 to be fully exposed. However, whenever shaving of the soft, pliable, tender skin of the underarm is to be shaved, skin smoothing/ stretching blade guard 21 is mounted in secure interengagement with rotary shaver 22, effectively blocking a major portion of slotted housings 25, 25 of hair cutting assemblies 24, 24.

In addition, blade guard 21 preferably incorporates upstanding ridge 34 to controllably smooth and/or stretch the skin surface of the underarm as rotary shaver 22 is employed with blade guard 21 securely mounted thereto. As a result, the prior art difficulties are completely eliminated and a rotary shaver for use by ladies in comfortably and conveniently shaving both legs and underarms is achieved, producing a close, irritation-free shave on both legs and underarms.

In FIG. 5, an alternate embodiment of removable, skin smoothing/stretching blade guard 21 is depicted. In this embodiment, shaver 22 is constructed in a substantially identical manner, as well as blade guard 21. However, in this embodiment, upper plate 30 of blade guard 21 comprises a flat surface forming the top thereof, eliminating the incorporation of upstanding ridge 34, as found in the previous embodiment.

As shown in FIG. 5, in this alternate embodiment, blade guard 21 incorporates apertures 32 and 33 which peripherally surround and are cooperatingly association with housings 25, 25 of hair cutting assemblies 24, 24. In addition, apertures 32 and 33 are defined by edge 35 which are positioned in juxtaposed, spaced cooperating relationship with the sides of slotted housings 25, 25.

This embodiment of blade guard 21 is also constructed for removable locking interengagement with rotary shaver 22. If desired, the locking system detailed above can be employed. Alternatively, any other locking system which provides rapid locked interengagement and quick disconnection of blade guard 21 from shaver 22 can also be employed.

Although this embodiment of blade guard 21 eliminates upstanding ridge 34, top surface 26 of shaver 22 is effectively raised from adjacent the bottom edge of slotted housings 25, 25 to the elevated position defined by the top surface of upper plate or platform 30 of blade guard 21. As shown in FIG. 5, the top surface of plate or platform 30 effectively blocks a substantial portion of slotted housings 25, 25, thereby preventing unwanted pinching or irritation of the soft, pliable, tender skin typically found in underarm areas.

In general, it has been found that blade guard 21 should block at least 50% of the vertical height of each slotted housing 25 in order to provide the desired reduced irritation and/or cutting, typically found in prior art ladies' rotary shavers. However, if desired, upper plate or platform 30 may be constructed at a substantially greater thickness or vertical height, effectively blocking up to 100% of the vertical height of each slotted housing 25. In this way, the amount of cutting achieved by the side edge of slotted housings 25, 25 is completely controlled and the irritation or cutting of the underarm skin surface is virtually eliminated.

Although the thickness or vertical height of platform 30 of blade guard 1 may vary between 50% and 100% of the vertical height of slotted housing 25, a vertical height of between about 60% and 80% of the vertical height of slotted housing 25 is preferred. In this way, an optimum balance is achieved for obtaining both a smooth, comfortable, close shave and eliminating irritation or cutting of the underarm area.

It will thus be seen that the objects set forth above, among those made apparent from the preceding description, are efficiently attained and, since certain changes may be made in the above product without departing from the scope of the present invention, it is intended that all matter contained in the above description or shown in the accompanying drawings shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

Having described my invention, what I claim is new and desire to secure by Letters Patent is:

1. A shaver for providing a close and comfortable shave on both legs and underarms, said shaver comprising:

A. a housing;

B. at least two rotationally driven cutting blades mounted to the housing;

C. at least two slotted holders mounted to the housing, each slotted holder comprising a. a top surface and an outer wall connected to and extending from the top surface and a plurality of slots formed in the top surface and the outer wall, and b. constructed for over lying, peripheral surrounding engagement with a respective one of said cutting blades for cooperating therewith to cut hairs entering the slots of the holder; and D. a cutting guard member comprising a. an enlarged plate removably mountable to the housing;

b. at least two apertures formed in the plate, each aperture being positioned for receiving engagement with one slotted holder in peripheral surrounding juxtaposed relationship therewith, partially blocking a portion of the outer wall of the holder and the slots formed therein, and c. interlocking means formed on the guard member for cooperating with the housing to enable secure engagement with the housing as well as easy removal therefrom;

whereby close and comfortable shaving of both underarms and legs is attained by employing the guard member for shaving the soft, pliable, tender skin of the underarms, while removing the guard member for close shaving of legs.

2. The shaver defined in claim 1, wherein the slotted holders are for receiving the rotationally driven cutting blades therein and each comprises a substantially circular shaped outer peripheral wall extending from the housing for contacting a skin surface to be shaven, and the apertures formed in the cutting guard member each each comprises a substantially circular shape for peripherally surrounding the outer wall of the slotted holder in juxtaposed, spaced, peripheral alignment therewith, partially blocking a portion of the slots formed in the outer wall and preventing the skin surface and the hair fibers extending therefrom from engaging with the blocked portion of the outer wall of the slotted holder.

3. The shaver defined in claim 2, wherein said cutting guard member further comprises a side wall peripherally surrounding and extending from the large plate, with said side wall being constructed for peripherally surrounding and engaging the housing for mounted connection therewith.

4. The shaver defined in claim 3, wherein said housing comprises engagement means extending outwardly therefrom for cooperatively contacting the side wall of the cutting guard member and the interlocking means of the cutting guard member is further defined as comprising a receiving zone for engaging with the engagement means of the housing for securely retaining the cutting guard member on the housing when desired.

5. The shaver defined in claim 4, wherein said interlocking means further comprises elongated slots formed in the side wall of the cutting guard member for cooperatively engaging and interlocking with the engagement means of said housing, thereby securely affixing the cutting guard member to the housing when desired.

6. The shaver defined in claim 3, wherein said cutting guard member is further defined as comprising an outwardly extending flange peripherally surrounding a major portion of the side wall and positioned for cooperation with the interlocking means, for enabling the interlocking means to be quickly and easily disengaged from the housing when desired by merely pressing on said outwardly extending flange.

7. The shaver defined in claim 2, wherein said cutting guard member further comprises a ridge mounted to the enlarged plate and extending substantially perpendicularly therefrom in peripheral surrounding engagement with a major portion of each of said apertures.

8. The shaver defined in claim 7, wherein said ridge further comprises a continuous ridge peripherally surrounding and substantially encircling each of said apertures substantially in their entirety.

9. The shaver defined in claim 8, wherein said continuous ridge is spaced away from the aperture for defining a substantially flat, ring shaped surface between the edge of the aperture and said ridge.

10. The shaver defined in claim 7, wherein the enlarged plate of the cutting guard member has a thickness sufficient to peripherally surround and effectively block at least 50% of the vertical height of the slots formed in the outer wall of the slotted holder.

11. The shaver defined in claim 10, wherein the thickness of the plate of the cutting guard member is constructed to effectively block between about 60% and 80% of the vertical height of the slots formed in the outer wall of the slotted holder.

12. A guard member for being removably mounted to a rotary blade shaver having a housing incorporating at least two rotationally driven cutting blades, each contained within a slotted holder mounted to the housing, for enabling the shaver to be comfortably used on both legs and underarms, said guard member comprising A. an enlarged plate;

B. a side wall connected to the plate and constructed for cooperative mounted engagement and rapid disengagement with the housing of the shaver;

C. at least two apertures formed in the plate, each aperture being a. defined by an edge, and b. constructed for peripherally surrounding a respective one of said slotted holders, with the edge thereof in partially blocking relationship with the slotted holder;

D. locking means formed on the side wall of the guard member and constructed for cooperating with the housing of the shaver to enable secure retained locked engagement of the guard member to the housing and easy removal therefrom when desired; and E. a ridge mounted to the plate and extending substantially perpendicularly therefrom in peripheral surrounding engagement with a major portion of each of said apertures, whereby the rotary shaver is usable for comfortably shaving both legs and underarms by merely mounting the guard member to the shaver when needed, and removing the guard member when not required.

13. The guard member defined in claim 12, wherein the slotted holders each comprises a substantially circular shaped top portion, an outer peripheral wall extending from the top portion, and a plurality of slots formed in the top portion and the outer wall and the edge of each aperture formed in the guard member is further defined as comprising a substantially circular shape for peripherally surrounding the outer wall of the slotted holder and being in juxtaposed, spaced, peripheral alignment therewith, partially blocking a portion of the slots formed in the outer wall and preventing the skin surface and the hair fibers extending therefrom from engaging with the blocked portion of the slots of the outer wall of the slotted holder.

14. The guard member defined in claim 13, wherein the edge of each aperture formed in the guard member has a thickness sufficient to peripherally surround and effectively block at least 50% of the vertical height of the slots formed in the outer wall of the slotted holder.

15. The guard member defined in claim 14, wherein the thickness is constructed to effectively block between about 60% and 80% of the vertical height of the slots formed in the outer wall of the slotted holder.

16. The guard member defined in claim 12, wherein said ridge further comprises a continuous ridge peripherally surrounding and substantially encircling each of said apertures substantially in their entirety.

17. The guard member defined in claim 16, wherein said continuous ridge is spaced away from the aperture for defining a substantially flat, ring shaped surface between the edge of the aperture and said ridge.

18. The guard member defined in claim 12, wherein said guard member further comprises an outwardly extending flange peripherally surrounding a major portion of the side wall and positioned for cooperation with the locking means, for enabling the locking means to be quickly and easily disengaged from the housing when desired by merely pressing on said outwardly extending flange.

* * * * *